US005515443A

United States Patent [19]

Meyer

[11] Patent Number: 5,515,443

[45] Date of Patent: May 7, 1996

[54] INTERFACE FOR SERIAL DATA TRASMISSION BETWEEN A HEARING AID AND A CONTROL DEVICE

[75] Inventor: Wolfram Meyer, Moehrendorf, Germany

[73] Assignee: Siemens Aktiengesellschaft, Munich, Germany

[21] Appl. No.: 218,581

[22] Filed: Mar. 28, 1994

[30] Foreign Application Priority Data

Jun. 30, 1993 [DE] Germany ..... 43 21 788.5

[51] Int. Cl.[6] ..... H04R 25/00

[52] U.S. Cl. ..... 381/69; 381/68; 381/69.2

[58] Field of Search ..... 381/68, 68.2, 68.4, 381/58, 60, 69; 128/746; 73/585

[56] References Cited

U.S. PATENT DOCUMENTS

| | | | |
|---|---|---|---|
| 4,531,229 | 7/1985 | Coulter | 381/68 |
| 4,759,070 | 7/1988 | Voroba et al. | 128/746 |
| 4,961,230 | 10/1990 | Rising | 381/69.2 |
| 4,989,251 | 1/1991 | Mangold | 381/68 |
| 5,014,319 | 5/1991 | Leibman | 381/68.2 |

OTHER PUBLICATIONS

"Halbleiterschaltungstechnik," Titze et al., 6th Edition, 1983, pp. 658–651.

*Primary Examiner*—Forester W. Isen
*Assistant Examiner*—Xu Mei
*Attorney, Agent, or Firm*—Hill, Steadman & Simpson

[57] ABSTRACT

An interface for serial data transmission between a hearing aid and a control device has a first data terminal for bi-directional data transmission to and from the hearing aid, a second data terminal for receiving a data format containing a start bit from the control device, and a third data terminal for data to be received by the control device, plus at least one coupler for data transmission from the second terminal to the first data terminal and at least one coupler for data transmission from the first data terminal to the third data terminal. The two couplers have an interactive (shared) connection which is normally placed at a first logic level, but which can be modified to a second logic level by signals either from the control device or from the hearing aid. The logic level at which the interactive connection is set determines which path data will be transmitted between respective terminals.

7 Claims, 1 Drawing Sheet

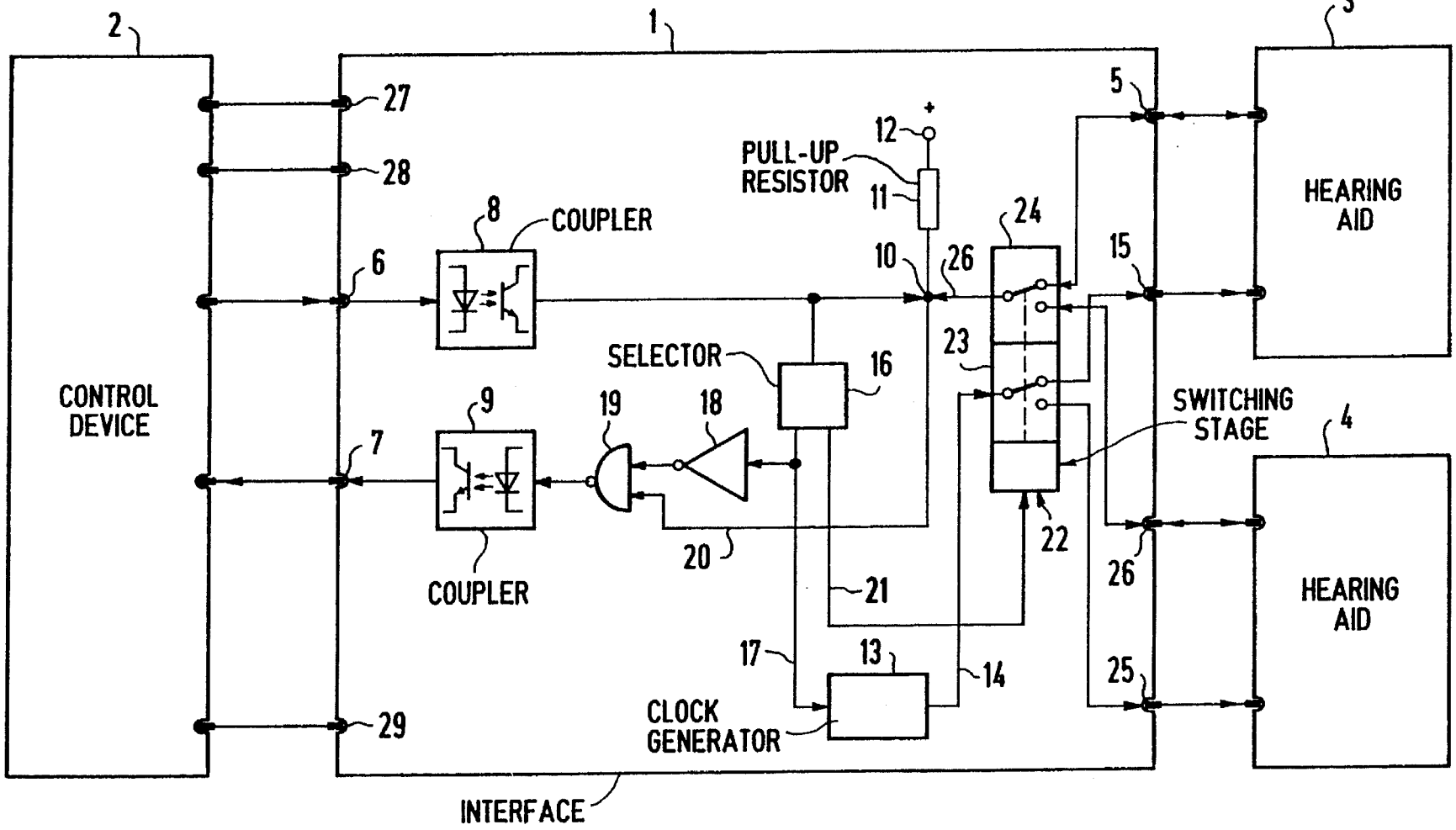
HEARING AID
HEARING AID
SWITCHING STAGE
PULL-UP RESISTOR
SELECTOR
CLOCK GENERATOR
COUPLER
COUPLER
INTERFACE
CONTROL DEVICE
1
2
3
4
5
6
7
8
9
10
11
12
13
14
15
16
17
18
19
20
21
22
23
24
25
26
27
28
29

INTERFACE FOR SERIAL DATA TRASMISSION BETWEEN A HEARING AID AND A CONTROL DEVICE

BACKGROUND OF THE INVENTION

1. Field of the Invention

The present invention is directed to an interface for serial data transmission between a hearing aid and a control device, such as a personal computer.

2. Description of the Prior Art

Interfaces for serial data transmission between a hearing aid and control device are known having a basic terminal configuration which includes a first data terminal for bi-directional data transmission to and from the hearing aid, a second data terminal for data having a format containing a start bit sent from the control device, and a third data terminal for data to be received by the control device.

In known interfaces of this type, the incoming data are briefly intermediately stored and/or edited with respect to the data format, i.e. transformed, using relatively complicated means in the interface. As a result, chronological delays occur in all instances between the data arriving at the interface and the data departing from the interface. The text "Halbleiterschaltungstechnik," Titze et al., 6th Edition, 1983, Springer Verlag, Berlin, pages 658–661 describes a serial V.24 interface for data transmission between a computer and a picture screen or printer terminals. The required data terminals are separated in potential, and coupling means between the terminals are provided in the form of optocouplers.

SUMMARY OF THE INVENTION

It is an object of the present invention to provide an interface of the type having the above-identified arrangement of first, second and third data terminals, for use with a hearing aid which enables data transmission between the hearing aid and a control device in a technologically simple manner and in a manner which assures the safety of the hearing aid user.

It is a further object of the present invention to provide such an interface wherein chronological delays in the transmission of the data via the interface are avoided.

The above objects are achieved in accordance with the principles of the present invention in a serial data interface having the aforementioned configurations of first, second and third data terminals, wherein the interface has first coupling means for data transmission from the second data terminal to the first data terminal and second coupling means for data transmission from the first data terminal to the third data terminal, and wherein the two coupling means are connected to the first data terminal of the hearing aid via a common branching point in the interface. The common branching point is normally set a first logic level, but can be modified to a second logic level. Data are transmitted between the respective terminals through the common branching point dependent on the logic level at which the common branching point is set. The control device, for data transmission to the hearing aid, transmits signals via the second data terminal to the interface, via the first coupling means to the branching point, and via the first data terminal to the hearing aid. Data from the hearing aid are suppliable via the first data terminal to the branching point, at which data sent from the hearing aid can be inserted into the data format sent by the control device. The thus-augmented data format can then be supplied via the second coupling means and via the third data terminal to the control device.

An intermediate storage and/or editing or transformation of the data format are not necessary in the interface of the invention due to the use coupling means. The necessary patient safety as well as the separation in potential between the control device and the hearing aid are also achieved. An important advantage achieved by the interface of the invention is that data received, for example, via the second data terminal can be isochronically transmitted to the first data terminal and to the third data terminal. Further, data received via the first data terminal from the hearing aid can also be transmitted without delay in the interface to the third data terminal. Consequently, a data format transmitted by the control device is supplied to the hearing aid without chronological delay via the interface of the invention. Data bits contained in the data format can be interpreted in the hearing aid. If the data format transmitted by the control device contains no data bits for the hearing aid, the hearing aid can, in turn, insert data bits into the received data format and send an augmented data format back to the control device via the interface, without chronological delay and/or transformation of the data format.

DESCRIPTION OF THE DRAWINGS

The single FIGURE is a schematic block diagram of an exemplary embodiment of an interface unit constructed in accordance with the principles of the present invention, connected to a control device and to two hearing aids.

DESCRIPTION OF THE PREFERRED EMBODIMENTS

The FIGURE shows an interface 1 constructed in accordance with the principles of the present invention which connects a control device 2, for example a computer (PC), programming device or remote control device, to a first hearing aid 3, for example for a right ear, or to a second hearing aid 4, for example for a left ear. These units are connected for serial data transmission therebetween. The interface 1 has a first data terminal 5 for bi-directional data transmission to or from the hearing aid 3, and a second data terminal 6 for data signals sent from the control device 2. The interface 1 also has a third data terminal 7 for data to be received by the control device 2. For data transmission from the second data terminal 6 to the first data terminal 5, the interface 1 includes a first coupler 8. The interface 1 also has a second coupling 9 for data transmission from the first data terminal 5 to the third data terminal 7. The coupling 8 and 9 can be fashioned in any suitable manner and may, for example, be uni-directional couplers, for example, optocouplers. A branching point 10 is present between the first data terminal 5 and the second data terminal 6. This branching point 10 is normally at a first logic level. The first logic level, however, can be modified both by signals (data) from the control device 1 and by signals (data) from the hearing aid 3. The first logic level is modified by these signals to a second logic level. The first logic level, for example, can be generated with a pull-up resistor 11 (or with a pull-down resistor (not shown)) in a technologically simple manner, by connection to a corresponding voltage source.

A positive voltage is connected to a terminal 12 at the pull-up resistor 11, as a result of which the logic level is pulled-up at the branching point 10, to the extent that no opposing signals arrive via the first data terminal 5 or via the second data terminal 6. When data signals with the opposite level arrive from the first data terminal 5 or from the second data terminal 6, the first logic level of the branching point 10 is modified to a second (opposite) logic level (pulled-down) for the duration of the presence of the opposite level.

In an embodiment of the invention, the couplers 8 and 9 are both fashioned as voltaic separating elements between the data terminals 5 and 6, or the data terminals 5 and 7. To that end, for example, optocouplers or transformational couplers can be employed. Due to the voltaic separation with the couplers 8 and 9, a higher patient safety and separation of potential between the control device 2 and the hearing aid 3 or the hearing aid 4 are achieved in a simple way.

Moreover, the couplers 8 and 9 can be both fashioned for matching different logic voltage levels which are prescribable at the respective data terminals 5 through 7. This can be achieved in a simple manner, for example, with the pull-up resistor 11 and a corresponding voltage source at the terminal 12 when the couplers themselves exhibit transistor functions, as indicated in the drawing in the case of the couplers 8 and 9 fashioned as optocouplers. For generating the first logic level at the branching point 10, further couplers and/or transistor functions of, for example, an integrated circuit can be employed.

In the exemplary embodiment shown in the drawing, the first coupling 8 effecting data transmission from the second data terminal 6 to the first data terminal 5, and has its output connected to the first logic level at the branching point 10. The second coupler 9 effects data transmission from the first data terminal 5 to the third data terminal 7, and has its input connected to the first logic level at the branching point 10.

The interface 1 includes a clock generator 13 from which clock signals can be supplied to, for example, the hearing aid 3 via a line 14 and via a clock terminal 15 at the interface 1. The clock generator 13 generates the clock signals synchronously with the bit sequence of the data format which can be received via the second data terminal 6. To that end, a start bit is selected from the data format by means of a selector 16, for example a D-flip-flop, in combination with counters, dividers or the like, and is supplied via a line 17 to the clock generator 13.

In the present exemplary embodiment, the selected start bit is supplied via an inverter 18 and via an NAND element 19 to the third data terminal 7 at the interface 1, and can consequently be employed as starting information for a read event in the control device 2. The start bit selected by the selector 16 is consequently doubly utilized by the interface 1.

In the exemplary embodiment, the selector 16 is connected to the branching point 10 following the first coupler 8. It is also possible, however, to connect the selector 16 to the second data terminal 6 preceding the first coupler 8. Depending on the polarity of the logic level which is present at the terminal of the selector 16, the inverter 18 may be omitted.

Via a line 20, the NAND element 19 receives the signals (data bits) sent from the hearing aid 3 via the first data terminal 5. These signals sent from the hearing aid 3 can be read by the control device 2 by attaching the start bit in the NAND element 19. Another equivalent logic operation can be utilized instead of the NAND element 19.

In a further embodiment of the invention, a control bit can be selected from the receivable data format with the selector 16, this control bit being supplied via a line 21 to a switching stage 22. The switching stage 22 may be, for example, an electronic switching stage having a first switching element 23 and/or a second switching element 24. The line 14 for the clock signals of the clock generator 13 is connected either to the first clock terminal 15 or to a second clock terminal 25 corresponding thereto by means of the first switching 23. Additionally, a signal line 26 at the branching point 10 can be switched from the first data terminal 5 to a fourth data terminal 26 corresponding thereto, by the second switching element 24.

With such a fashioning of the interface 1, the two hearing aids 3 and 4 can be simultaneously connected to the interface of the invention, the hearing aids 3 and 4 being optionally connected or disconnected by the control bit sent from the control device 2. As a result, the hearing aid 3 for the right ear and the hearing aid 4 for the left ear can be driven and balanced for a hearing aid user by means of only one interface which is simply constructed.

The serial interface, for example V24 or RS232, of the control device 2 can be connected to the interface of the hearing aid 3 or of the hearing aid 4 by means of the interface 1 of the invention. The interface 1 can have further terminals, for example power supply terminals 27 and 28 and a grounding terminal 29. As a result, the interface 1 can be supplied with current in a simple manner by the control device 2. Power and grounding connections can similarly be provided between the interface 1 and the hearing aids 3 or 4.

A data format sent by the control device 2 is immediately and automatically used for generating the data format of the information to be received by the control device 2. If an answerback is received, the hearing aid 3 or 4 can merely insert a few data bits into the transmitted data format. To that end, the interface 1 can send the clock signals generated by the clock generator 13 to the respective hearing aid 3 or 4.

In a further embodiment of the invention, the interface 1 can undertake a division of the data format sent by the control device 2 into data bits and a start bit. This permits each of the hearing aids 3 or 4 to send data back to the control device 2 without any information-oriented modifications whatsoever in the interface 1. Because the chronologically correct acceptance or offering of the information by the hearing aid 3 or 4 is defined by the clock signal generated in the interface 1, data to be transmitted can also be distributed among a plurality of data formats (i.e., a transmission frame).

Although modifications and changes may be suggested by those skilled in the art, it is the intention of the inventor to embody within the patent warranted hereon all changes and modifications as reasonably and properly come within the scope of his contribution to the art.

I claim as my invention:

1. In an interface for serial data transmission between a hearing aid and a control device, said interface having a first data terminal for bi-directional data transmission to or from said hearing aid, a second data terminal for a data format sent by said control device having a start bit, and a third data terminal for data to be transmission to the control device, the improvement comprising:

first coupling means for transmitting data from said second data terminal to said first data terminal;

second coupling means for transmitting data from said first data terminal to said third data terminal;

said first and second coupling means being connected to said first data terminal via a common branching point in said interface, said common branching point being settable respectively at first and second logic levels, data being transmitted from said control device via said second data terminal, said first coupling means, said branching point and said first data terminal to said hearing aid when said branching point is at one of said logic levels and data being transmitted from said hearing aid via said first data terminal, said branching point, said second coupling means and said third data terminal to said control device when said branching point is at the other of said logic levels; and means for augmenting, at said branching point, data sent from said control device to said hearing aid with data inserted into said data format from said hearing aid for undelayed, direct transmission without storage to said control device via said second coupling means.

2. The improvement of claim 1 further comprising a clock signal generator in said interface;

a clock terminal for supplying said clock signal to said hearing aid; and selector means for selecting said start bit from said data format for controlling said clock generator to generate said clock signal synchronously with the bit sequence of said data format.

3. The improvement of claim 2 further comprising:

said interface having a further clock terminal; and switching means, which is caused to switch by a bit selected from said data format, for selectively supplying said clock signal to one of said clock terminal or said further clock terminal.

4. The improvement of claim 1 further comprising:

said interface having a fourth data terminal; and switching means, which is switched by a bit selected from said data format in said interface, for connecting said first data terminal to said second data terminal or said fourth data terminal.

5. An interface as claimed in claim 1 wherein each of said first and second coupling means comprise means for performing a transistor function.

6. An interface as claimed in claim 1 wherein each of said first and second coupling means comprise voltaic separating means for separating voltages between the respective first, second and third data terminals.

7. An interface as claimed in claim 1 wherein each of said first and second coupling means comprise means for matching respectively different voltage levels which are present at said first, second and third data terminals.

* * * * *